US006486860B1

(12) United States Patent
Eschbach

(10) Patent No.: US 6,486,860 B1
(45) Date of Patent: Nov. 26, 2002

(54) DISPLAY UNIT WITH AN LED MATRIX

(75) Inventor: Bernd Eschbach, Karlsruhe (DE)

(73) Assignee: Dambach-Werke GmbH, Kuppenheim (DE)

( * ) Notice: Subject to any disclaimer, the term of this patent is extended or adjusted under 35 U.S.C. 154(b) by 0 days.

(21) Appl. No.: 09/036,386

(22) Filed: Mar. 6, 1998

(30) Foreign Application Priority Data

Mar. 15, 1997 (DE) ..... 197 10 855

(51) Int. Cl.[7] ..... G09G 3/32
(52) U.S. Cl. ..... 345/82; 345/904; 345/44
(58) Field of Search ..... 345/147, 82, 83, 345/904, 204, 44; 340/815.45

(56) References Cited

U.S. PATENT DOCUMENTS 3,909,788 A * 9/1975 Kaelin et al. ..... 340/825.82
4,103,299 A * 7/1978 Swinehart ..... 340/506
5,198,803 A * 3/1993 Shie et al. ..... 345/82
5,301,200 A * 4/1994 Killinger ..... 714/819
5,317,307 A * 5/1994 Thomas, Jr. ..... 30/815.45
5,656,935 A * 8/1997 Havel ..... 324/115
5,684,368 A * 11/1997 Wei et al. ..... 315/302
5,719,589 A * 2/1998 Norman et al. ..... 345/82
5,724,055 A * 3/1998 Omae ..... 345/82
5,892,504 A * 4/1999 Knapp ..... 345/204
5,903,246 A * 5/1999 Dingwall ..... 345/82

FOREIGN PATENT DOCUMENTS

DE 2727800 1/1979
DE 3620584 4/1987
DE 4024499 9/1991
DE 4203276 4/1993
GB 2000 343 A * 6/1978 ..... G06F/9/32

* cited by examiner

*Primary Examiner*—Steven Saras
*Assistant Examiner*—Fritz Alphonse
(74) *Attorney, Agent, or Firm*—Pauley Petersen Kinne & Erickson

(57) ABSTRACT

A display unit with an LED matrix, particularly for outdoors, with display points arranged in lines and columns, which can be triggered by a control device and which are monitored for display errors by a monitoring device. A simple design provides a dependable function because the monitoring device has a current monitoring device with a current sensor, by which a trigger current for each display point can be detected and assigned to the respective display point by the monitoring device.

11 Claims, 2 Drawing Sheets

DISPLAY UNIT WITH AN LED MATRIX

BACKGROUND OF THE INVENTION

1. Field of the Invention

This invention relates to a display unit with an LED matrix, in particular for outdoors, with display points arranged in lines and columns, which can be triggered by a control device and which are monitored for display errors by a monitoring device.

2. Description of Prior Art

It is assumed that a display unit with an LED matrix with a monitoring device for display errors is known. There, the monitoring device is elaborate and not capable to detect the exact location of an erroneous display.

A monitoring unit for display errors in connection with an LED display device in the form of a display with seven segments is disclosed in German Patent Publication DE 27 27 800, which has a current sensor transistor. The use of such a monitoring device in connection with an LED matrix does not recommend itself since, because of the plurality of display points, a large outlay would be required. A similar monitoring device for an LED display device in connection with a segment display is also disclosed in German Patent Publication DE 36 20 584 A1, wherein the open collector output of the segment display is uscd. This type of monitoring device also is not suitable for a display unit with an LED matrix.

A matrix display device is known from German Patent Publication DE 40 24 499 C1, wherein the display points are formed by means of the light output ends of optical fibers. Bistable closing elements are arranged over the light output ends of the optical fibers for creating various displays. For opening, or respectively for closing the closing elements, setting and resetting pulses are applied to the letter in lines and columns and are monitored by respective optical couplers. A separate monitoring circuit is required to determine whether the display points are actually illuminated.

SUMMARY OF THE INVENTION

It is one object of this invention to provide a display device with an LED matrix, which offers dependable functional monitoring along with a simple construction.

This object is attained as discussed in the specification and required by the claims. Accordingly, the monitoring device has a current monitoring device with a current sensor, by means of which a trigger current for each display point can be detected and assigned to the respective display point by the monitoring device. With these measures, every display point of the display device is monitored and a localization of the defective display point is available.

The outlay for triggering the display device and the required output, along with simultaneous dependable functional monitoring of the individual display points, is reduced because one current sensor is provided per line or per column. The columns and lines corresponding to the coordinate points of the display points to be activated can be triggered cyclically in multiplex operation with a frequency which results in an activation of the LEDs to be triggered above the flicker fusion frequency of the eye. In the process an optimal display quality is maintained, wherein it is possible to achieve a high luminance by the level of the triggering pulses, which can be tuned to the existing exterior light conditions by means of a modulation of the pulse width.

The location of the respectively activated display point can be simply determined because current signals of the current sensors in the control device returned by an acknowledgment line can be evaluated in respect to an error of the display point to be activated on the basis of the time information of the line triggering present in the control device, together with the time information of the column triggering. By the step the current sensors are constituted by an optical coupler, which is connected in parallel with the line triggering lines, or respectively the column triggering lines, and it is possible to detect the triggering current free of potential and to return the information regarding this to the control device for evaluation without triggering being affected.

Different evaluations and reactions in case of an error are made possible in a simple manner because the control device has an error memory in which error reports can be deposited. An error indication and/or switch-off of the display device can be controlled on the basis of the deposited error reports. For example, it is possible to make the error criteria a function of several successive measurements. It can be decided whether an error report should be made when one or several illuminated points fail, or whether, with a defined, predeterminable number of missing illuminated points, the display device should be switched off because of displays which can no longer be clearly recognized (garbling).

In order to make possible a large-area display with dependable operation, the display can be composed of several display modules, that display module can have a control unit with an error memory, which is part of the control device. Each display module is controllable and the total display can be put together from the displays of the individual display modules by means of the control device. It is also possible with these measures to determine whether a display module needs to be replaced.

The monitoring device can be completed because a reference element per display module is provided, by which a long-term change of the display properties of the display module can be detected, and/or because a temperature sensor per display module is provided, and that by means of the control unit a reference element signal, or respectively a temperature sensor signal, can be evaluated in respect to a deviation from a set value.

For example, if the achievable luminance is reduced below a predeterminable threshold, or if the color values of a color display device change by a predeterminable value in relation to a reference value, it is possible to output corresponding information for replacing the display module. It is, for example, possible to switch on a ventilator on the basis of the signal from the temperature sensor.

BRIEF DESCRIPTION OF THE DRAWINGS

This invention will be explained in more detail in what follows by means of an exemplary embodiment, making reference to the drawings, wherein.

DESCRIPTION OF PREFERRED EMBODIMENTS

Figure 1:
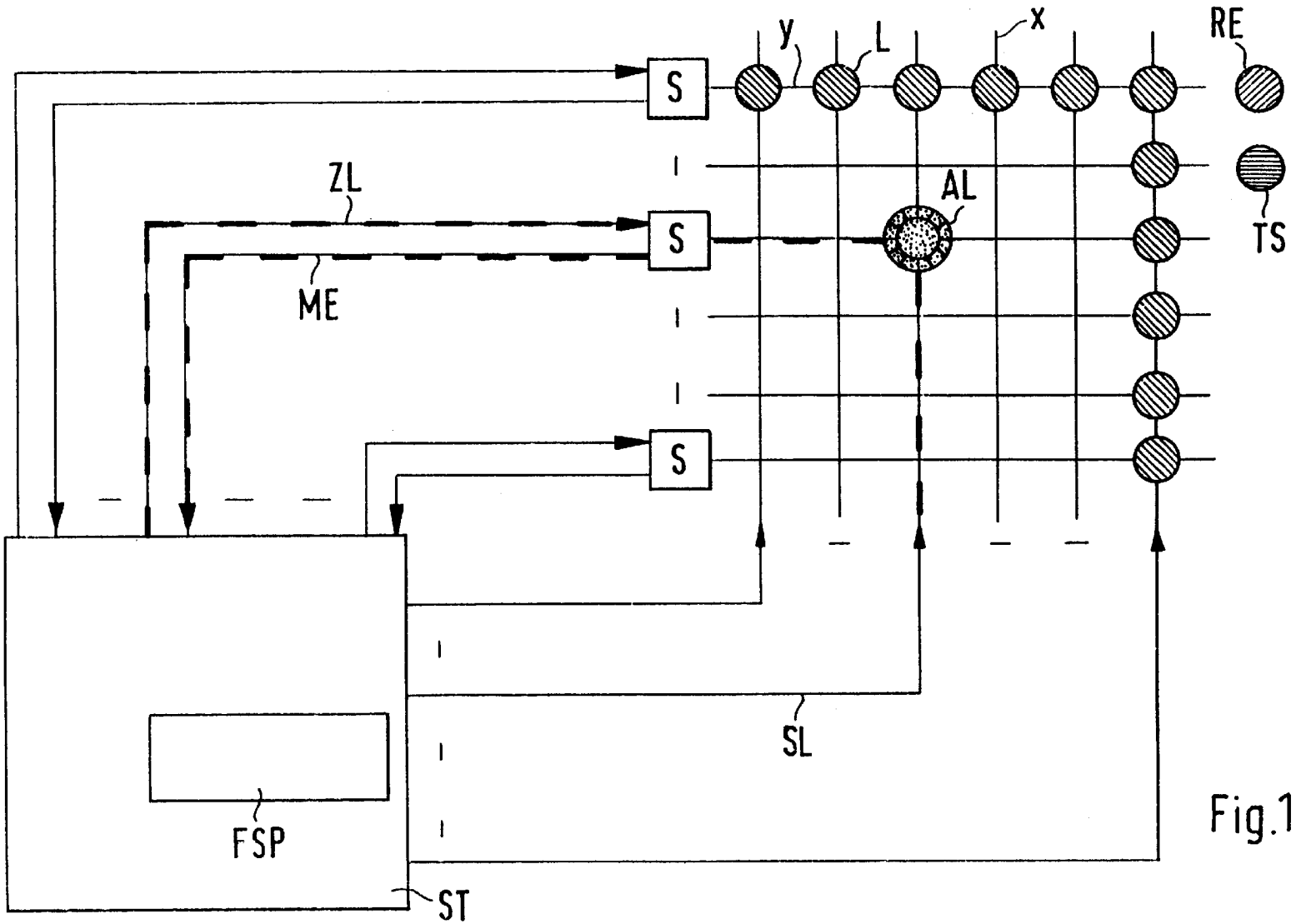
FIG. 1 schematically shows a design of a display device with an LED matrix, and FIG. 2 schematically shows a portion of the display device with an LED matrix in accordance with FIG. 1 with a more detailed representation of a current sensor.
Figure 2:
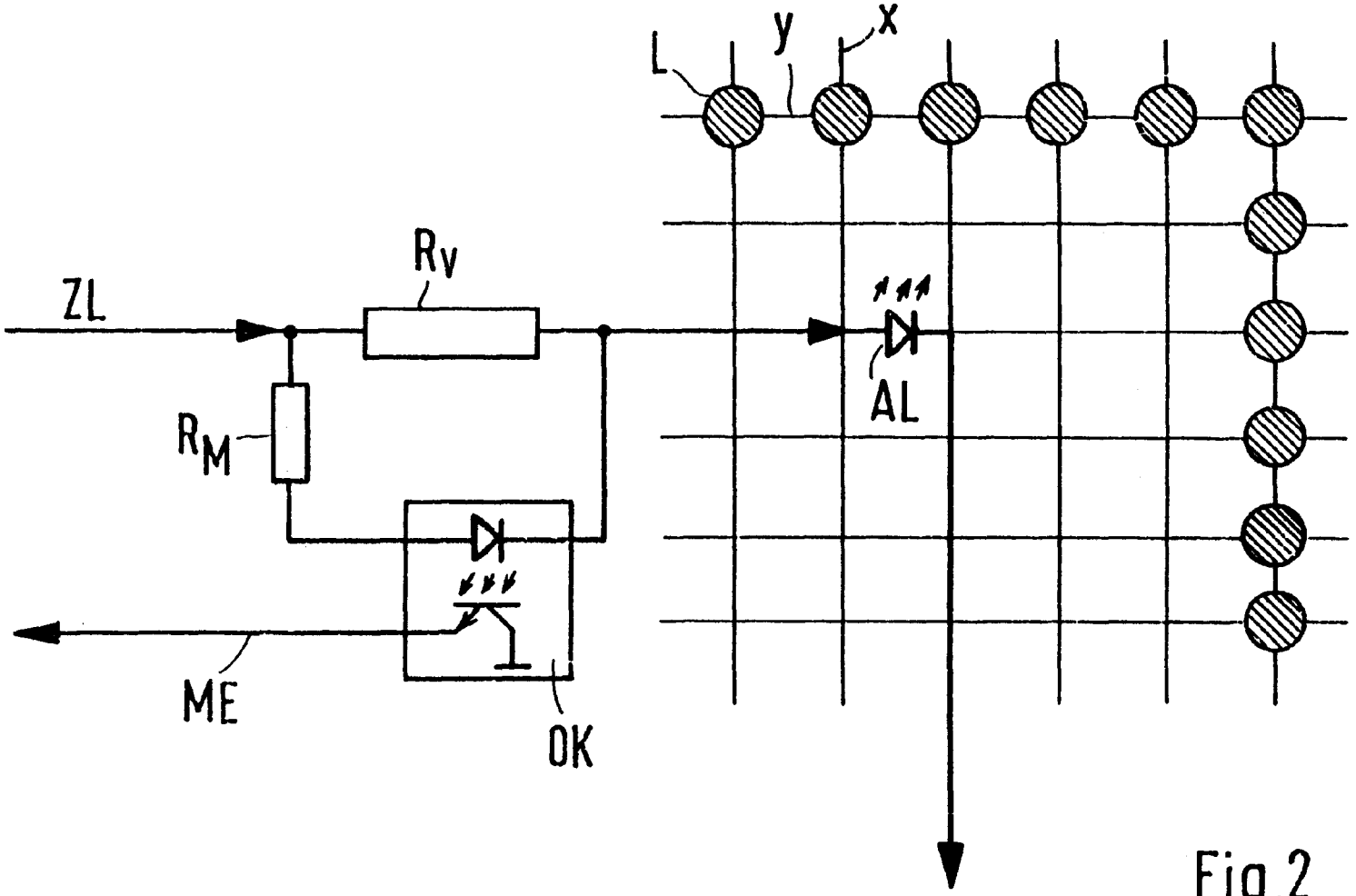

The design of a display device with an LED matrix is schematically represented in FIGS. 1 and 2.

According to FIG. 1, the display device has an LED matrix with display points L arranged in lines y and columns x, which are represented by one LED or a group of LEDs. It is possible by means of a group of LEDs per display point L to achieve increased display luminances in case of high ambient luminance or in connection with color displays.

The display points L have a trigger current from a control unit ST, which is supplied to the respective activated display point AL by the actuation of the corresponding coordinate point xy via an associated line trigger line ZL and an associated column trigger line SL. A current sensor S is arranged in the current path, namely upline in the line control line ZL of each display point L, by means of which the trigger current of the activated display point AL (illuminated point) is detected and is supplied via an acknowledgment line ME to the control unit ST. An error memory FSP is arranged in the control unit ST, in which an identification is stored in case of a missing or defective trigger current. Alternatively, the arrangement of the current sensors S is also possible in the column trigger line SL.

As shown in FIG. 2, the display points L are triggered via a series resistor $R_V$. The current sensor S in the form of an optical coupler OK is connected in series with a precision resistor $R_M$ in parallel with the series resistor $R_V$. The optical coupler OK performs a potential-free current measurement and does not interfere with the trigger current.

Thc entire display device can comprise a plurality of display modules, which are constructed in accordance with the above description. The display of the individual display modules can be coordinated to form a total display by means of a control device, of which the control unit ST with the error memory FSP is a part. Each display module has its own monitoring device, by means of which display errors within the display module can be detected and evaluated. It is also possible to perform a further error analysis of the display modules in the higher control device.

Error detection in the control unit takes place together with the trigger information, present in the control unit, of the individual display points L. Triggering of the display points L is performed line-by-line and column-by-column in a multiplex operation, wherein per display module only respectively one display point L, which possibly can comprise several LEDs, is triggered at one time. In this case the triggering frequency is so high that the intermittent triggering cannot be detected by the eye, i.e. lies above the flicker fusion frequency. The luminance of the display point L in this case can be selected by means of pulse width modulation, wherein relatively large instantaneous luminances can be achieved by means of pulse width triggering. Since the triggering times of the respective activated display point AL are known in the control unit ST, it is possible to utilize the respective trigger current and a current detected by means of the current sensor S for localizing the respectively triggered activated display point AL and, when a defective current is detected, storing it in the error memory FSP with an appropriate identification. In connection with a group of LEDs L, information is also known to the control unit as to how high the trigger current needs to be so that it is also possible by means of a comparison with the acknowledgment signal of the current sensor S, to determine the outage of individual LEDs by a comparison with the respective set value. In connection with a color display, wherein the individual LEDs per display point L are triggered according to a color to be displayed, it is also possible to make conclusions regarding the correct color display. By means of the sequential control of all display points L, there is complete monitoring of the display device.

It is possible to fix the required conclusions regarding the error treatment in an evaluation unit in the control unit or the higher control device. Decisions can be made whether an error report should be made in case of the outage of one or several display points L. At a defined, predeterminable number of missing active display points AL, the display device can be switched off because of displays which can no longer be clearly recognized, which is known as garbling.

In order to even further improve the functional monitoring of the display modules, a reference element RE can be provided, for example for long-term monitoring of the luminance and/or color reproduction. In case of a deviation from a predeterminable set value, the appropriate information for replacing the display module can be output via the control unit, or respectively the control device. In addition, a temperature sensor TS can be provided at a suitable location, for example for activating a cooling device or to switch off the display device in case of danger.

What is claimed is:

1. In a display unit with an LED matrix with display points arranged in lines and columns, which can be triggered by a control device and which are monitored for display errors by a monitoring device, the improvement comprising:

monitoring device having a current monitoring device with a current sensor (S) detecting a trigger current for each said display point (L) and assigning the trigger current to a respective display point (AL) by means of the monitoring device, and a plurality of current signals of the current sensors (S) in a control device (ST) returned by an acknowledgment line (ME) evaluated with respect to an error of the display point (AL) on a basis of a first time information of a line triggering present in the control device (ST) together with a second time information of a column triggering.

2. In a display unit in accordance with claim 1, wherein there is one said current sensor (S) for each said line (y) and each said column (x), and the columns (x) and the lines (y) corresponding to a plurality of coordinate points (x, y) of the display points (AL) to be activated are triggered cyclically in multiplex operation at a frequency wherein the LEDs are triggered above a flicker fusion frequency of an eye.

3. In a display unit in accordance with claim 2, wherein the current sensors (S) each comprise an optical coupler (OK) connected in parallel with one of the line triggering lines (ZL) and the column triggering lines (SL).

4. In a display unit in accordance with claim 3, wherein the control device (ST) has an error memory (FSP) in which error reports are deposited, and one of an error indication and a switch-off of the display unit is controlled as a function of deposited error reports.

5. In a display unit in accordance with claim 4, further comprising: a plurality of display modules, each said display module having the control unit (ST) with the error memory (FSP) of the control device, each said display module being controllable, and a total display assembled from an array of displays of the individual display modules by means of the control device.

6. In a display unit in accordance with claim 5, further comprising: a reference element (RE) per said display module having a detectable long-term change of display properties of the display module, a temperature sensor (TS) per said display module, and one of a reference element signal from the control device (ST) and a temperature sensor signal being evaluated with respect to a deviation from a set value.

7. In a display unit in accordance with claim 1, wherein the current sensors (S) each comprise an optical coupler (OK) connected in parallel with one of line triggering lines (ZL) and column triggering lines (SL).

8. In a display unit in accordance with claim 1, wherein a control device (ST) has an error memory (FSP) in which error reports are deposited, and one of an error indication and a switch-off of the display unit is controlled as a function of deposited error reports.

9. In a display unit with an LED matrix with display points arranged in lines and columns, which can be triggered by a control device and which are monitored for display errors by a monitoring device, the improvement comprising:

the monitoring device having a current monitoring device with a current sensor (S) detecting a trigger current for each said display point (L) and assigning the trigger current to a respective display point (AL) by means of the monitoring device;

there being one said current sensor (S) for each said line (y) and each said column (x), and the columns (x) and the lines (y) corresponding to a plurality of coordinate points (x, y) of the display points (AL) to be activated being triggered cyclically in multiplex operation at a frequency wherein the LEDs are triggered above a flicker fission frequency of an eye; and a plurality of display modules, each said display module having a control device (ST) with an error memory (FSP) of the control device, each said display module being controllable, and a total display assembled from an array of displays of the individual display modules by means of the control device.

10. In a display unit in accordance with claim 9, wherein a plurality of current signals of the current sensors (S) in a control device (ST) returned by an acknowledgment line (ME) are evaluated with respect to an error of the display point (AL) on a basis of a first time information of a line triggering present in the control device (ST) together with a second time information of a column triggering.

11. In a display unit in accordance with claim 9, further comprising: a reference element (RE) per said display module having a detectable long-term change of display properties of the display module, a temperature sensor (TS) per said display module, and one of a reference element signal from the control unit (ST) and a temperature sensor signal being evaluated with respect to a deviation from a set value.

* * * * *